United States Patent [19]

Bardutzky et al.

[11] Patent Number: 4,594,068

[45] Date of Patent: Jun. 10, 1986

[54] ROLL-FUSING APPARATUS

[75] Inventors: Bernd Bardutzky, Kriftel; Reinhard Dinges, Bad Soden am Taunus; Peter Gumm, Glashütten, all of Fed. Rep. of Germany

[73] Assignee: Hoechst Aktiengesellschaft, Frankfurt am Main, Fed. Rep. of Germany

[21] Appl. No.: 622,447

[22] Filed: Jun. 20, 1984

[30] Foreign Application Priority Data

Jun. 27, 1983 [DE] Fed. Rep. of Germany ..... 3323067

[51] Int. Cl.[4] ..... B21B 31/08

[52] U.S. Cl. ..... 432/60; 432/8; 219/469; 219/216; 29/132

[58] Field of Search ..... 432/60, 8; 219/469, 219/216; 29/132

[56] References Cited

U.S. PATENT DOCUMENTS

| | | | |
|---|---|---|---|
| 3,884,623 | 5/1975 | Slack | 432/60 |
| 3,902,845 | 9/1975 | Murphy | 219/469 |
| 3,999,038 | 12/1976 | Sikes, Jr. et al. | 432/60 |
| 4,042,804 | 8/1977 | Moser | 219/216 |
| 4,050,886 | 9/1977 | Moser | 432/60 |
| 4,207,059 | 6/1980 | Gaitten et al. | 432/60 |
| 4,232,959 | 11/1980 | Ateya et al. | 355/3 FU |
| 4,269,594 | 5/1981 | Umans et al. | 432/59 |

FOREIGN PATENT DOCUMENTS 0017092 3/1982 European Pat. Off. .

OTHER PUBLICATIONS

*Rollfuser*, by Fathergill et al., IBM Technical Disclosure Bulletin, vol. 16, No. 3, p. 896, Aug. 1973.

*Primary Examiner*—Henry C. Yuen

*Attorney, Agent, or Firm*—Schwartz, Jeffery, Schwaab, Mack, Blumenthal & Evans

[57] ABSTRACT

Disclosed is a roll-fusing apparatus comprising a heated fusing roller and a pressure roller which form a roller gap therebetween. The shape of the non-cylindrical roller core and the coating of the pressure roller makes it possible to fuse the toner images on copy supports which remain free of wrinkles after passing through the roller gap. In addition, duplication of the copy image does not occur up to DIN A1 size copies. The roller core and the coating of the pressure roller, comprising a silicone elastomer coating and a shrunk-on tubing have varying thicknesses over the length of the roller. As a result, the speed of passage of the copy support at the edges of the roller gap is modified, compared with the speed of passage obtained with a pressure roller having a cylindrical roller core and a cylindrical coating.

9 Claims, 4 Drawing Figures

ROLL-FUSING APPARATUS

BACKGROUND OF THE INVENTION

The present invention relates to a roll-fusing apparatus comprising a pressure roller and an internally heated fusing roller for fusing a toner image on a copy support, wherein the pressure roller comprises a coated hollow roller core supported on a shaft.

European Pat. No. 17,092 discloses a roll fuser of this type, which is equipped with a pair of rotatable rollers, one of which has end portions which are tapered in the direction of the outer ends. The roller comprises an outer shell which is centrally supported on a shaft. The main parts of the inner surface of the shell are provided with stepped portions of increasing diameters at each tapered end of the shell. In the tapered end portions of the shell, plugs are mounted on parts of the shaft, which are axially displaceable by means of screw threads. The main body of each plug has a diameter which is smaller than the portion of the internal surface of the shell. The plugs are rotatable on the shaft and can be moved from a retracted position, in which a clearance exists between the plugs and the shell of the roller, into an engaged position, in which end flanges of the plugs engage with the stepped portions of the shell. In the retracted position of the plugs, the end portions of the shell are not mechanically supported by the flanges of the plugs and, as a consequence, the pressure exerted by the back-up roller forces the tapered end portions of the shell against the plugs. The amount of taper and the size of the gap between the plugs and the shell are such that the behavior of the roller under the action of contact pressure corresponds to that of a substantially cylindrical roller, i.e., a roller which is not tapered.

The tapered configuration of the roller is maintained, on the other hand, when the end plugs are screwed inwardly in the axial direction. Under the action of pressure contact, a resulting concave contact area leads to a condition in which wrinkling of the copy paper in a high-humidity state is precluded.

When the end plugs are screwed outwardly in the axial direction, the roller operates in the manner of a substantially cylindrical roller which does not have a taper. As a result of the contact pressure which is exerted by the back-up roller, the tapered configuration of the roller is flattened. The application of the roller under this condition prevents the so-called "smearing effect" on the copy, which occurs in a dry state, i.e., at very low humidity. The position of the plugs can be manually adjusted when the two rollers are out of contact or it can be adjusted by means of a motor which is under control of a humidistat.

By supporting the tapered external zones, a higher circumferential speed is produced close to the edges of the roller, so that a copy paper which passes through the gap between the two rollers is conveyed at a higher peripheral speed along its edges, compared to the speed in the middle. As a result, the copy paper is stretched and does not form wrinkles, even at higher humidity. Under very dry conditions, the higher speed in the external zones causes the middle of the copy paper to form a buckle, so that the toner image, which is to be fused, prematurely contacts the fusing roller, shortly before it enters into the fusing apparatus, and thus smearing of the image may result.

U.S. Pat. No. 4,232,959 discloses a toner image fusing apparatus including a heated roller and a pressure roller, wherein a temperature sensor measures the surface temperature of the heated roller, and the contact pressure exerted by the pressure roller on the heated roller is then varied as a function of the measured surface temperature. These measures are taken in an attempt to achieve a uniform quality of fusion of the toner image on a copy sheet which is passed between the two rollers, since the process of fusing is influenced both by means of temperature and also by means of contact pressure between the two rollers. The pressure-temperature relationship is such that, for example, contact pressure is reduced when surface temperature rises and contact pressure is increased when surface temperature drops. In the process, the interrelation between these two variables is controlled on the basis of a predetermined relationship between surface temperature and contact pressure.

In the fusing apparatuses of the prior art, either a roller is used, in which the end portions are tapered in the outward direction and which is deformed under the action of contact pressure exerted by another roller, in order to obtain a favorable pressure profile over the length of the roller and thus prevent wrinkling; or contact pressure between the fusing roller and pressure roller is varied according to the measured temperature such that a predetermined relationship between pressure and temperature is maintained.

SUMMARY OF THE INVENTION

It is an object of the present invention to provide a roll-fusing apparatus wherein the contact pressure between the pressure roller and the fusing roller is modified such that wrinkling or buckling of the copy material is prevented.

It is another object of the present invention to provide a roll-fusing apparatus as above, which processes copies of DIN A4 through DIN A1 sizes, comprising all types of copy materials such as opaque papers, transparent papers or films.

A further object of the present invention is to provide an apparatus as above in which the so-called "bow-wave" effect is essentially eliminated.

In accomplishing the foregoing objects, there has been provided in accordance with the present invention a roll-fusing apparatus, comprising an internally heated fusing roller and a pressure roller, comprising a radially symmetrical, non-cylindrical hollow roller core supported on a shaft, and a coating applied to the roller core wherein the coating varies in thickness over the length of the roller core. The roller core may have either a concave or convex outer profile, and the coating comprises a corresponding convex or concave inner profile and a substantially cylindrical outer configuration. Both the roller and the coating exhibit axial symmetry about their respective midpoints. In addition, a shrunk-on film tubing comprising a perfluoroethylene/propylene-containing compound may be disposed on the outside surface of the pressure roller coating. This tubing is axially symmetrical about its midpoint, and the end zones may comprise a conical taper toward the ends thereof.

Further objects, features and advantages of the present invention will become apparent from the detailed description of preferred embodiments which follows, when considered together with the attached figures of drawing.

DETAILED DESCRIPTION OF PREFERRED EMBODIMENTS

The present invention provides a roll-fusing apparatus wherein the non-cylindrical roller core of the pressure roller is provided with a coating which varies in thickness over the length of pressure roller.

In one embodiment of the invention, the coating of the pressure roller has a convex profile with a cylindrical outer configuration, and its shape over the length of the roller is such that it is symmetrical relative to the middle of the roller. The diameters of the end faces of the roller core of the pressure roller are, for example, up to about 4 mm greater than the diameter in the middle of the roller core.

In a further embodiment of the present invention, the coating of the pressure roller has a concave profile, and the minimum thickness of the layer is at the midpoint M of the roller. The coating comprises a cylindrical outer configuration, and the shape of the coating over the length of the roller is such that it is symmetrical relative to the middle of the roller. The coating of the pressure roller optimally comprises a silicone elastomer which is additionally covered with a shrunk-on film tubing. In still another embodiment of the invention, the central zone of the shrunk-on film tubing has a uniform thickness, and the external zones of the shrunk-on film tubing are conically tapered toward the end faces of the pressure roller.

In the text which follows, the invention is described in detail with reference to illustrative embodiments shown in the accompanying drawings.

Figure 1:
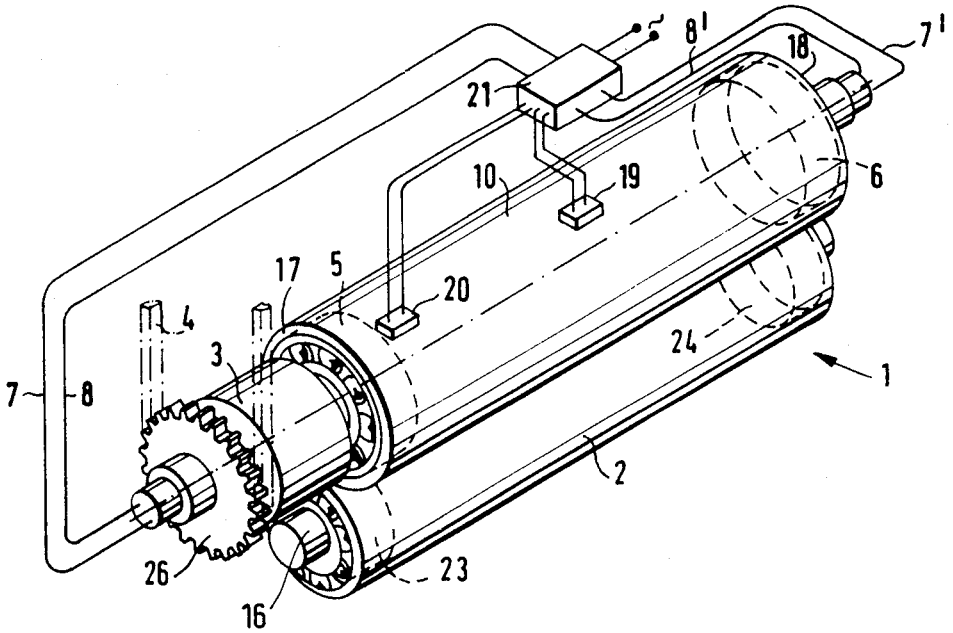
FIG. 1 is a diagrammatic, perspective view of a fusing apparatus according to the present invention.

A fusing apparatus 1 shown in FIG. 1 comprises a heated, or fusing roller 10 and a pressure roller 2. The upper heated roller 10 is supported in bearings 5 and 6, for example ball bearings, and the lower pressure roller 2 is supported in bearings 23 and 24. In each case, the bearings are arranged in the interior of the rollers, and the rollers are internally supported at a distance of about 20 mm from their respective end faces. The upper heated roller 10 has a length of about 670 mm and usually comprises an aluminum tube which has a wall thickness of from about 5 to 10 mm and a silicone elastomer coating which has a thickness of from about 1 to 1.2 mm. The silicone elastomer coating ends at a distance of from about 30 to 32 from the end faces 17 and 18 of the heated roller 10. The pressure roller 2 also comprises an aluminum cylinder which has a wall thickness of from about 4 to 7 mm and is covered with a coating comprising a silicone elastomer and a tubing formed of a shrink film. The maximum thickness of the silicone elastomer coating together with the tubing cannot exceed about 5 mm. This coating extends from end face to end face of the pressure roller.

The pressure roller 2 interacts with the heated roller 10 to seize the copy material and convey it through the gap between the two rollers.

The shaft section jutting out from the end face 17 of the roller 10 supports a clutch 3 equipped with a gear wheel 26 which is driven by a cogged V-belt 4 or a roller chain.

Near the surface of the heated roller 10 and opposite to the center of the roller, a temperature sensor 19 is arranged, which may comprise a thermistor, an NTC resistor, a thermocouple, or a pyrometer. The two connecting wires of the temperature sensor are linked up with a control means 21, which controls the flow of the copying program and is diagrammatically indicated in FIG. 1. Another temperature sensor 20, for example, a thermistor, an NTC resistor, a thermocouple, or a pyrometer, is provided near the surface and in the vicinity of the end face 17 of the heated roller 10 and is also connected to the control means 21 by its two connecting wires. The two temperature sensors ensure that the energy supply to heating elements positioned in the interior of the heated roller 10 is interrupted, when predetermined temperatures have been reached at the measuring points. Connecting wires 7 and 8 and 7' and 8' are run out of the interior of the heated roller 10 to the control means 21. The control means comprises a control circuit for actuating relays which disconnect the heating elements from the power supply, when predetermined nominal temperatures have been reached.

When fusing apparatuses of the prior art are adjusted such that the temperature over the length of the fusing roller and the contact pressure between the fusing roller and the pressure roller are as uniform as possible, an undesirable formation of wrinkles generally occurs in the middle of the copy. Close investigations indicate that this wrinkling is caused by transverse shrinkage of the copy material, produced by the fusing heat. As a result of this shrinkage, the speed of passage in the roller gap is higher in the middle of the roller arrangement than at the edges thereof. The external zones of the copy material are then pushed together toward the middle, and a longitudinal buckle is formed, which is squeezed together to give a wrinkle as the material passes through the roller gap. Wrinkling occurs predominantly in the central area of the second half of a DIN A1 or DIN A2 copy on transparent paper.

Another problem encountered with conventional fusing apparatuses which are intended for use in the production of large-size copies, results from duplicating of the copy image by a double print, in which a second image, which is displaced by only a few tenths of a millimeter with respect to the first image, appears in the second half of a DIN A1 or DIN A2 copy, mostly in the case of copies on opaque paper. This phenomenon can possibly be explained by the fact that a so-called "bow-wave" extending transversely to the process direction forms in the middle of the copy material as it passes through the apparatus, so that the toner image which is present on the "bow-wave" prematurely contacts the heated roller and, as a result, a so-called "cold-offset effect" occurs and gives rise to the second image which is displaced with respect to the first image.

The above-described phenomena are caused by a difference in the speed of the middle and the edges of the copy materials as they pass through the fusing roller gap. This difference in travelling rate is due to both elastic deformations of the rollers and their coatings, as well as to different degrees of transverse shrinkage of the copy material. In the case of high transverse shrinkage, the external zones of the copy material are pushed in the direction of the middle of the copy material, and thus a longitudinal buckle forms in the middle, which leads to undesirable wrinkling as described above. To obviate wrinkling it is necessary to increase the speed of passage in the middle of the roller arrangement, in order to counteract a lateral pushing-together of the copy material toward the middle. This is achieved by a pressure roller 2 having a configuration as explained below, with reference to FIGS. 2 to 4.

Figure 2:
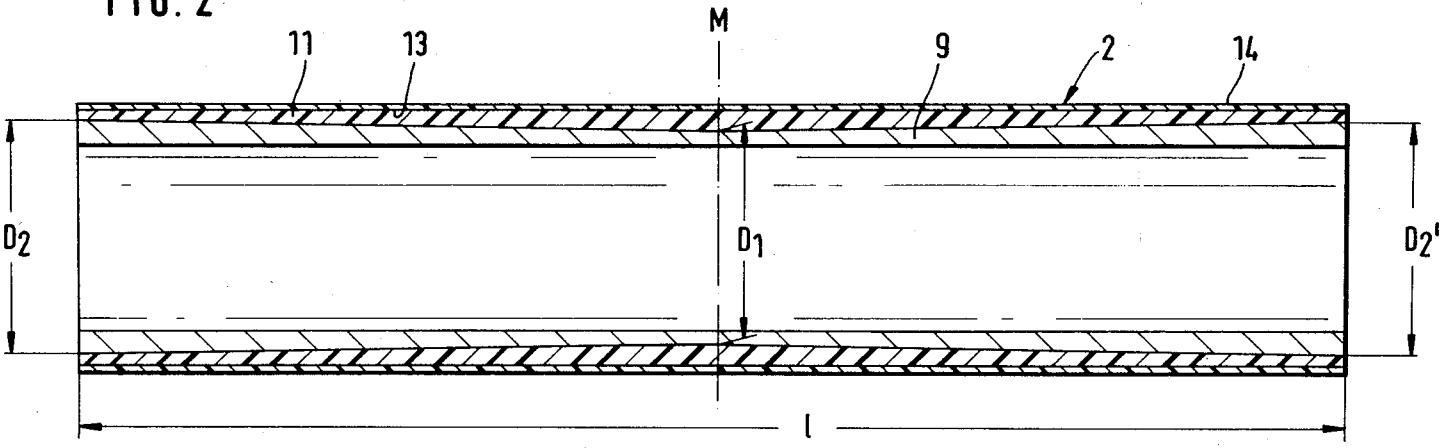
FIG. 2 is a cross-sectional view of a first embodiment of a pressure roller of the fusing apparatus according to FIG. 1.

The first embodiment of the pressure roller 2, which is shown in a sectional view in FIG. 2, preferably comprises an aluminum roller core 9, provided on its outside with a coating 11 comprising a silicone elastomer. The roller core 9 has a non-cylindrical configuration. The wall thickness thereof decreases from the end faces in the direction of the middle M of the pressure roller 2. The diameters $D_2$ and $D_{2'}$ of the end faces of the roller core 9 are, for example, up to about 4 mm greater than the diameter $D_1$ in the middle M of the roller core 9.

The silicone elastomer coating 11 has a convex profile, with the greatest layer thickness being in the middle of the roller, and it has a cylindrical outer configuration 13. The shape of the coating 11 over the length 1 of the roller is such that it is symmetrical relative to the middle M of the roller. A shrink tubing 14 of a film material which preferably comprises a perfluoroethylene/propylene copolymer is shrunk onto the coating 11. The maximum thickness of the coating 11 in the middle of the pressure roller 2 is from about 3 to 10 mm. The shrink tubing 14 has a thickness of up to about 1 mm.

As indicated in FIG. 1, the roller core 9 is supported on a shaft 16 of the pressure roller 2.

Since the wall thickness of the roller core 9 increases in the direction of its end faces, elastic deformation in the external zones of the pressure roller 2 is lower than in the middle M of the roller, when the pressure roller 2 is in contact with the heated roller 10. Consequently, contact pressure in the external zones is also higher than in the central zone. The resulting higher speed of passage in the external zones of the roller arrangement counterbalances the elevated speed of passage in the middle of the roller, which is at least in part caused by transverse shrinkage of the copy material due to its loss of moisture in the fusing process. The speed of passage of the copy material is then rendered approximately equal over the entire length of roller 1. The pressure roller 2 according to FIG. 2 is particularly suitable for use with transparent papers serving as copy materials.

Figure 3:
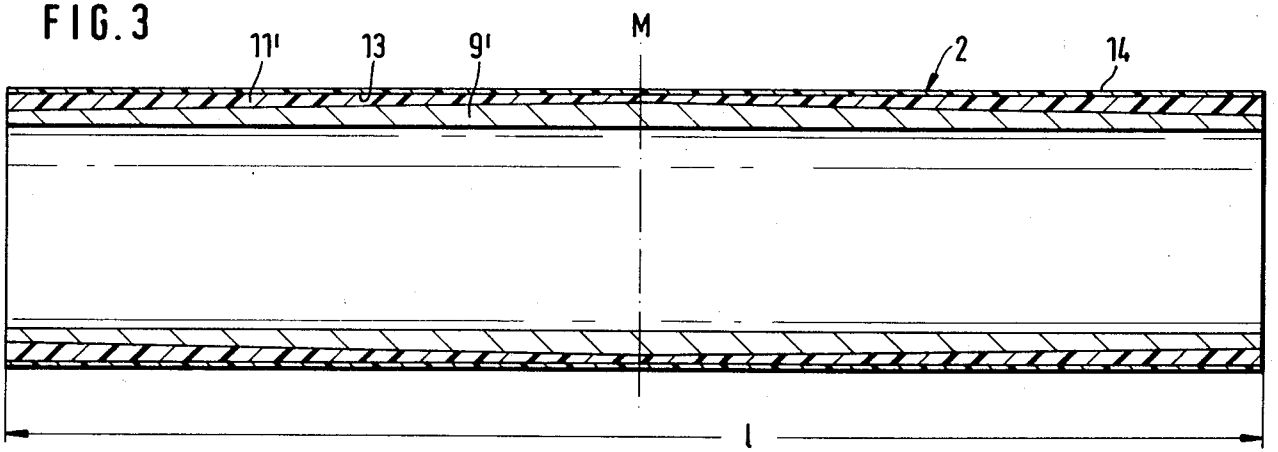
FIG. 3 is a cross-sectional view of a second embodiment of a pressure roller of the fusing apparatus according to FIG. 1.

When opaque papers are passed through the apparatus, a pressure roller built up as shown in FIG. 2 causes too high a speed of passage in the external zones, so that a large "bow-wave" can be formed, which leads to duplication of the image. To obviate this phenomenon, the pressure roller 2 is constructed as shown in FIG. 3. The roller core 9' has a configuration in which its diameter in the middle M of the roller is greater than the diameters of the end faces of the roller core. The silicone elastomer coating 11' which is applied to the roller core 9' has a concave profile with a cylindrical outer configuration 13. The shape of the coating 11' over the length of roller 1 is such that it is symmetrical relative to the middle M of the roller. When a pressure roller 2 of this type is used, the areas with the highest speed of passage in the roller gap are no longer effectively on the outside edges of the roller, but act closer to the middle of the roller. A pressure roller 2 of this shape is particularly advantageous when opaque papers are used as copy materials. As in the embodiment according to FIG. 2, a shrink tubing 14 of a film material which preferably comprises a perfluoroethylene/propylene copolymer is shrunk onto the coating 11'.

Figure 4:
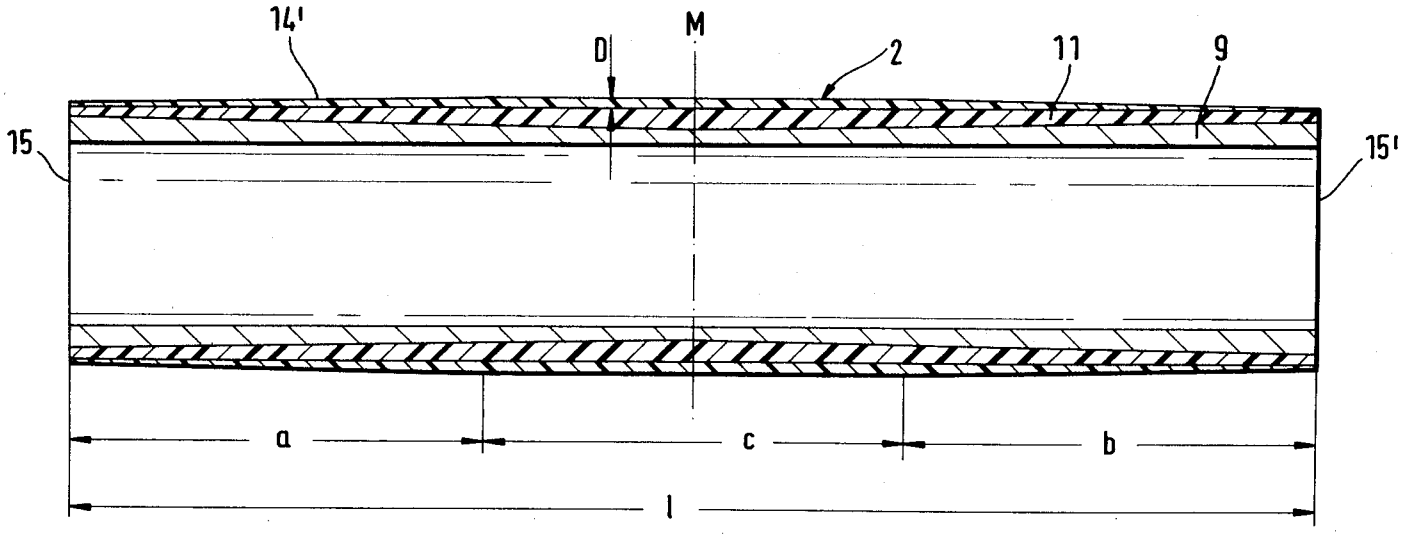
FIG. 4 is a cross-sectional view of a third embodiment of a pressure roller of the fusing apparatus according to FIG. 1.

FIG. 4 shows a further embodiment of a pressure roller 2, in which the roller core 9 is constructed in the same way as the roller core 9 according to FIG. 2. The exterior diameter of the roller core 9 in the middle M of the roller is smaller than the exterior diameters of the end faces 15 and 15' of the roller core. The silicone elastomer coating 11 has the greatest thickness in the middle M of the roller and decreases in thickness toward the edges of the pressure roller 2. The shrink tubing 14' fitted onto the coating 11 comprises a slightly conical configuration, for example, a reduced thickness of about 0.1 to 0.3 mm, in the external zones a and b, and a uniform thickness D in a central zone c. This pressure roller 2 is suitable for use with different copy supports, for example, opaque papers, transparent papers and films, since, compared with the pressure roller 2 according to FIG. 2, the areas with the highest speed of passage of the copy material in the roller gap are no longer situated right on the outsides, near the edges of the roller, but act closer to the middle M of the roller.

In opaque papers, the so-called "bow-wave" is thus reduced to such an extent that it can no longer have a disturbing effect, and duplicating of the copy image is prevented. On the other hand, the pressure roller is so elastic in the middle thereof that contact pressure is reduced, and the central zones of the copy material thus do not move on ahead of the edges. As a result, wrinkling is prevented.

It is generally considerably easier to shape the metallic roller core 9 and 9' in the embodiments of the pressure roller 2 according to FIGS. 2 and 4 than to shape the silicone elastomer coating 11 and 11' which is applied to a cylindrical roller core and which has the effect of equalizing the speed of passage of the copy material through the roller gap over the entire length of roller 1, up to a copy size which approximately corresponds to DIN A2.

What is claimed is:

1. A roll-fusing apparatus, comprising:

an internally heated fusing roller;

a pressure roller positioned adjacent to said fusing roller for fusing a toner image on a copy support which is conveyed between said rollers, said pressure roller comprising a radially symmetrical, non-cylindrical hollow roller core supported on a shaft, and a coating applied to the roller core, wherein the coating varies in thickness over the length of the roller core and has a complimentary configuration to the wall thickness of the core including a cylindrical outer configuration; and a shrunk-on film tubing having a central zone with a uniform thickness and two end zones which are conically tapered toward the end faces of the pressure roller.

2. A roll-fusing apparatus as claimed in claim 1, wherein the pressure roller coating comprises a silicone elastomer.

3. A roll-fusing apparatus as claimed in claim 1, wherein the shrunk-on tubing is axially symmetrical about its midpoint.

4. A roll-fusing apparatus as claimed in claim 1, wherein the pressure roller coating comprises a silicone elastomer, and a thickness of the pressure roller coating combined with the tubing does not exceed about 5 mm.

5. A roll-fusing apparatus as claimed in claim 1, wherein the pressure roller comprises a hollow aluminum tube having a wall thickness of from about 4 to 7 mm.

6. A roll-fusing apparatus as claimed in claim 5, wherein the pressure roller comprises a convex outer profile.

7. A roll-fusing apparatus as claimed in claim 1, further comprising temperature-sensing means disposed near the surface of the fusing roller, and a control means for regulating the temperature of the fusing roller.

8. A roll-fusing apparatus as claimed in claim 1, wherein the film tubing comprises a perfluoroethylene-propylene copolymer.

9. A roll-fusing apparatus as claimed in claim 7, further comprising a shrunk-on film tubing disposed on the outside of the pressure roller coating, wherein the thickness of the pressure roller coating is from about 3 to 10 mm at the midpoint thereof, and the thickness of the film tubing does not exceed about 1 mm.

* * * * *